US005308979A

United States Patent [19]

Villa-Aleman

[11] Patent Number: 5,308,979

[45] Date of Patent: May 3, 1994

[54] ANALYSIS OF HYDROGEN ISOTOPE MIXTURES

[75] Inventor: Eliel Villa-Aleman, Aiken, S.C.

[73] Assignee: The United States of America as represented by the United States Department of Energy, Washington, D.C.

[21] Appl. No.: 933,145

[22] Filed: Aug. 21, 1992

[51] Int. Cl.[5] ..... H01J 49/04

[52] U.S. Cl. ..... 250/288

[58] Field of Search ..... 250/288

[56] References Cited

U.S. PATENT DOCUMENTS 3,666,942 5/1972 Low et al. ..... 250/43.5
4,039,828 8/1977 Pokar et al. ..... 250/288
4,426,576 1/1984 Hurst et al. ..... 250/288
4,791,292 12/1988 Cooks et al. ..... 250/288
5,043,575 8/1991 Habfast et al. ..... 250/283

*Primary Examiner*—Jack I. Berman
*Attorney, Agent, or Firm*—Brian R. Tumm; Harold M. Dixon; William R. Moser

[57] ABSTRACT

An apparatus and method for determining the concentrations of hydrogen isotopes in a sample. Hydrogen in the sample is separated from other elements using a filter selectively permeable to hydrogen. Then the hydrogen is condensed onto a cold finger or cryopump. The cold finger is rotated as pulsed laser energy vaporizes a portion of the condensed hydrogen, forming a packet of molecular hydrogen. The desorbed hydrogen is ionized and admitted into a mass spectrometer for analysis.

20 Claims, 1 Drawing Sheet

ANALYSIS OF HYDROGEN ISOTOPE MIXTURES

BACKGROUND OF THE INVENTION

1. Field of the Invention

The present invention relates to analysis of the isotopic concentration of an element. In particular, the present invention relates to analysis of the concentration of hydrogen-isotope-containing mixtures. The United States Government has rights in this invention pursuant to Contract No. DE-AC09-89SR18035 between the U.S. Department of Energy and Westinghouse Savannah River Company.

2. Discussion of Background

Isotopes are atoms of the same element that differ in their number of neutrons; thus, they have slightly different masses. It is often desirable to measure the concentrations of isotopes in a sample containing one or more elements in a mixture, that is, the relative amounts of the isotopes of each element which are found in the sample. The isotopic concentration of hydrogen in particular is important. Hydrogen has three isotopes, called protium (H), deuterium (D), and tritium (T) to reflect the number of neutrons in their respective nuclei (one, two and three, respectively). Molecular hydrogen may include the combinations HD, HT, and DT as well as $H_2$, $D_2$, and $T_2$. The isotopic concentration of a hydrogen sample thus may include any one or some combination of these possibilities. (The term "hydrogen" is used throughout this specification in the elemental sense rather than the isotopic sense.)

Deuterium and tritium, in particular, are useful and valuable isotopes; they are also radioactive isotopes. In nuclear material production processes, it is important to determine the relative amounts of the various isotopes that are produced, as well as to monitor the facilities to assure worker safety. The concentrations of hydrogen isotopes in air are frequently measured in the course of environmental testing and monitoring. The ratio of deuterium to hydrogen (D/H ratio) is useful in dating soil and minerals exposed to solar wind irradiation, in analysis of planetary atmospheric gases, and, in analyzing the solar wind, to provide a limit for the D/H ratio in the sun (see Low, U.S. Pat. No. 3,666,942).

Methods for determination of hydrogen isotope concentration include deuterium separation by gas chromatography, mass spectrometry, high-resolution techniques such as Fourier Transform Mass Spectrometry (FTMS), and infrared absorption analysis of gas samples.

Low et al. (U.S. Pat. No. 3,666,942) describe a method for determining the amount of deuterium in a mixture containing hydrogen and low concentrations of deuterium, such as might be found in typical terrestrial hydrogen samples. A sample of the mixture is passed through a hydrogen-selective film to remove gases other than hydrogen. The hydrogen is carried to a chromatographic detector for a measurement of total hydrogen content, then to an ionization chamber where it is ionized to form an effluent containing $HD^+$ ions. The effluent is delivered to a high resolution infrared detector whose output signal depends on the $HD^+$ concentration. The ratio of the two signals is proportional to the H/D ratio of the initial sample.

A quadrupole mass spectrometer (QMS) can be used for separating isotopes, as in the system described by Habfast et al. (U.S. Pat. No. 5,043,575). A quadrupole mass filter is provided with a voltage supply device controlled by the ion separation system. The supply voltages of the filter are switched over synchronously with the varying mass deflection setting of the ion separation system, thereby controlling the range of masses allowed through the filter.

Pokar et al. (U.S. Pat. No. 4,039,828) show a QMS system for analyzing corrosive gases or gases tending to sublimate. The sample beam is collimated by an aperture before it enters the ionization chamber. The gas molecules which do not pass through the aperture are condensed out onto a liquid nitrogen cryopump, or "cooling finger."

Many of the presently-available methods for analyzing hydrogen isotope concentrations suffer from poor resolution due to interactions between the ions in the ion source or ion separator, homogeneity errors, and other sources of error. High-resolution systems such as FTMS are often prohibitively expensive: a typical FTMS system can cost ten times as much as a quadrupole mass spectrometer (QMS). Furthermore, adsorption of hydrogen isotopes on the walls of the system may decrease resolution due to "memory" effects. Such adsorbed hydrogen is difficult to eliminate and leads to errors in subsequent measurements. Finally, there is no known method which both minimizes adsorption effects and provides accurate and complete information about the isotopic concentration of a sample having a known volume, that is, the relative amounts of $H_2$, $D_2$, $T_2$, HD, HT, and DT found in the sample.

SUMMARY OF THE INVENTION

According to its major aspects and broadly stated, the present invention is an apparatus and method for determining the concentrations of hydrogen isotope combinations in a gaseous mixture. The apparatus includes a cylinder in which the sample to be analyzed is stored. A sample valve and inlet tube connect the cylinder to a chamber. A hydrogen-selective permeable filter is disposed within the inlet tube to preferentially admit hydrogen isotopes into the chamber. The chamber contains a rotatable cold finger or cryopump, maintained at a sufficiently low temperature that it will condense hydrogen gas.

To determine the hydrogen isotope concentration of a sample, the chamber is evacuated by a vacuum pump. A gate valve closes off the portion of the chamber that contains the cold finger. The sample valve is opened, and gas from the cylinder enters the inlet tube. The hydrogen in the sample permeates through the filter into the chamber, where some portion thereof condenses onto the cold finger. The sample valve is closed.

After a sufficient amount of hydrogen has condensed onto the cold finger, the gate valve is opened and the cold finger is rotated. A laser fires a succession of pulses to desorb and vaporize successive layers of hydrogen from the rotated cold finger. The desorbed hydrogen is ionized to form a mixture containing some or all of the possible isotopic combinations ($HH^+$, $DD^+$, $TT^+$, $HD^+$, $HT^+$, $DT^+$). The ions enter the QMS, and are analyzed by means well known in the art. The ion combinations produce signal intensities and wavelengths which are indicative of the concentrations of the various hydrogen isotopes in the sample.

This apparatus and method can be used to analyze the isotopic concentrations of hydrogen in gaseous mixtures such as air. Thus, the apparatus is especially suitable for environmental testing and monitoring. The apparatus can also be used in hydrogen production facilities, where the isotopic concentrations of both the product and the ambient air are of concern. With suitable modifications, the isotopic concentrations of other elements can be analyzed. For example, if oxygen isotopes are of interest, the same technique can be applied using a filter made of a material selectively permeable to oxygen rather than hydrogen.

An important feature of the present invention is the filter. The filter may be made of any material capable of preferentially passing the substance of interest or of preferentially excluding substances not of interest. For example, the filter may be made of nonporous palladium or a palladium alloy for hydrogen isotopes. The substance of interest preferentially permeates through the solid material of the filter rather than passing directly through structural features such as pores, fissures, or holes.

Another feature of the present invention is the combination of the rotatable cold finger or cryopump and the laser. The cold finger is maintained at a sufficiently low temperature that the element to be analyzed will condense thereon. The cold finger is rotated while the laser fires a succession of pulses to desorb successive layers therefrom. This combination produces a packet or pulse of gas molecules of substantially uniform kinetic energies and therefore different masses and velocities. The packet contains some or all of the possible hydrogen isotope combinations in the form of subpulses distributed according to their mass. Mass analysis is facilitated thereby because the velocities of the various isotope combinations differ, allowing their separation on a time-of-flight basis.

An additional feature of the present invention is the ionization step. The isotope mixture is preferably ionized by resonance enhanced multiphoton ionization (REMPI) or some other convenient technique that is capable of preferentially ionizing particular isotopes and isotope combinations. Since different isotopes of an element preferentially absorb light at different wavelengths, each isotope in the sample, from the lightest to the heaviest, is preferentially ionzed by tuning the laser wavelength in resonance to a particular isotope.

A further feature of the present invention is the use of sample packets or pulses. Pulses of hydrogen molecules desorbed from the cold finger contain some or all of the possible hydrogen isotope combinations in the form of subpulses distributed according to their mass. Ionization by REMPI yields an ion packet composed mainly of a particular isotope. The three-step separation process—time-of-flight (from the cold finger to the ionization region), ionization by REMPI (wavelength tunability), QMS mass filter—results in significantly improved overall sensitivity and accuracy of the measurement. Measurements of background ionization between measurements of the isotopic concentration of the gas of interest provide a method for overcoming the "memory" problem resulting from "old" hydrogen desorbing from the walls of the system. Since the sample is introduced as a pulse, the reading of the sample can readily be distinguished from background, so memory effects can be discounted from the sample signal.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
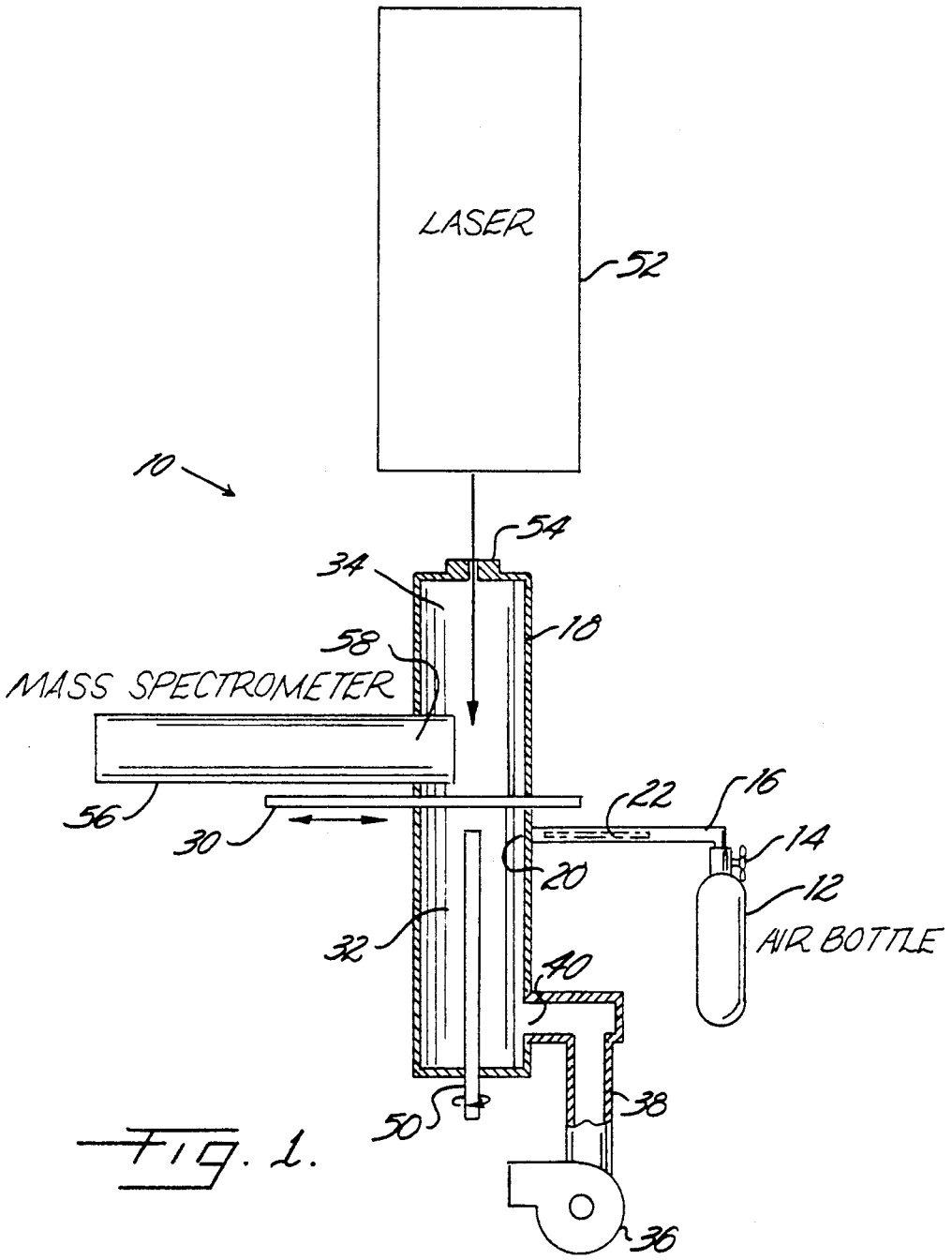
FIG. 1 is a schematic of an apparatus according to a preferred embodiment of the present invention.

Referring now to FIG. 1, there is shown an apparatus 10 according to a preferred embodiment of the present invention. A sample to be analyzed is stored in cylinder 12 having sample valve 14. Inlet tube 16 connects cylinder 12 to chamber 18 at port 20. Gas from cylinder 12 enters inlet tube 16 when sample valve 14 is open; no gas enters inlet 16 when valve 14 is closed. Sample valve 14 may include a pressure or flow sensor whereby the flow of gas from cylinder 12 into inlet tube 16 may be monitored. If desired, cylinder 12 may be omitted and the sample introduced directly into inlet 16.

It will be obvious to one of ordinary skill that various techniques may be used to pretreat the sample without departing from the spirit of the present invention. For example, liquid nitrogen traps, moisture traps to remove water or other liquids present in the sample, condensation apparatus, and so forth may be used to pretreat the air or gas flowing into inlet 16.

Filter 22 is disposed within tube 16. In a preferred embodiment of the present invention, filter 22 is selectively permeable to hydrogen, allowing any hydrogen in the sample to preferentially permeate through filter 22. The material of filter 22 is nonporous, that is, free from holes, pores, fissures, and other structural features that would permit the hydrogen to avoid passing through the material itself. Rather, the hydrogen molecules in the sample preferentially permeate through the solid material. Filter 22 may include any convenient hydrogen-permeable material, such as nonporous palladium or a palladium alloy. If filter 22 is made of nonporous palladium, filter 22 could be heated to approximately 150° C. to increase its preferential permeability to hydrogen. Filter 22 may, in such case, be heated by heating coils or other means well known in the art.

If desired, a flow meter or other suitable measuring device may be located in inlet tube 16, near port 20, to measure the input of hydrogen into chamber 18. It should be noted, however, that many samples of interest will contain too little hydrogen to be effectively monitored by such means.

Gate valve 30, indicated schematically in FIG. 1, is slidable in chamber 18 by some convenient means (not shown). When closed, valve 30 divides chamber 18 into first chamber 32 and second chamber 34. Port 20 is located in first chamber 32. Vacuum pump 36 is operatively connected to chamber 18 via connector 38, entering chamber 18 at port 40. Rotatable cold finger or cryopump 50 is located in chamber 18, such that cold finger 50 is entirely in first chamber 32. Cold finger 50 is rotatable by some convenient means (not shown), and maintained at a sufficiently low temperature that hydrogen, or other substance of interest, will condense thereon. Thus, the temperature of cold finger 50 is no higher than, and preferably somewhat lower than, the condensation temperature of hydrogen (approximately −252° C., or 21° K.). Cold finger 50 may, for example, be maintained at approximately the temperature of liquid helium (about 270° C., or 4° K.). Chamber 18 and other parts of apparatus 10 are thermally isolated from the surrounding environment by any convenient, well-known means.

Light from pulsed laser system 52 enters chamber 18—second chamber 34—at port 54. Laser 52 is any convenient type of pulsed laser, such a YAG, IR, or UV system. Mass spectrometer system 56 is operatively connected to chamber 18 at port 58.

System 56 is any convenient type of mass spectrometer, but preferably a QMS system having a quadrupole mass filter. A QMS is particularly advantageous in that it can separate ions which differ by as little as one mass unit. Alternatively, system 56 may be some other convenient type of mass spectrometry system. It is well known that different types of systems have differing capabilities: thus, FTMS systems have very good mass resolution, but may be an order of magnitude more expensive than a typical QMS system.

To determine the hydrogen isotope concentration of a gaseous mixture, chamber 18 is evacuated by vacuum pump 38. Gate valve 30 is closed, sample valve 14 is opened, and gas from cylinder 12 enters inlet 16. The hydrogen in the sample permeates through filter 22 into first chamber 32. The hydrogen expands into first chamber 32 and some portion thereof condenses onto cold finger 50.

Valve 30 closes off first chamber 32—that part of chamber 18 in which cold finger 50 is located—during hydrogen condensation onto cold finger 50. Thus, gate valve 30 helps reduce background measurement error by minimizing the initial sample volume. It will be understood that the particular arrangement of the components of apparatus 10 shown in FIG. 1 may be varied, depending on such factors as the specific configurations of said components and the constraints of the particular application. Thus, depending on the arrangement of QMS 56, laser system 52, cold finger 50, ports 20 and 40, and so forth, gate valve 30 may be omitted from apparatus 10.

Sample valve 14 is closed when the desired sample amount has left cylinder 12, or when the desired amount of hydrogen has entered chamber 32. As time passes, more and more of the hydrogen contained in the first chamber 32 condenses onto cold finger 50. The time required to accumulate sufficient hydrogen for isotopic analysis will depend on such factors as the sample volume, the hydrogen concentration of the original sample, the speed of hydrogen permeation through filter 22, the volume of chamber 32, and the temperature of cold finger 50.

After a sufficient amount of hydrogen has condensed onto cold finger 50, gate valve 30 is opened and cold finger 50 is rotated. Laser 52 is directed at cold finger 50 and its surface layers of adsorbed hydrogen. Laser 52 fires a succession of pulses to desorb and vaporize successive layers of hydrogen from rotating cold finger 50. The number of pulses needed for sufficient desorption depends on such factors as how much hydrogen is condensed onto cold finger 50, the temperature and rotation rate of cold finger 50, and the pulse duration and repetition rate, and may be calculated by one of ordinary skill.

Upon entering chamber 32, the hydrogen isotope particles have differing velocities and kinetic energies as well as differing masses. As more and more hydrogen particles enter chamber 32, these particles undergo collisions with the walls of chamber 32 and with each other. If hydrogen were allowed to merely accumulate in chamber 32 until enough was present for analysis, the resulting sample would have a broad range of kinetic energies.

Condensing the hydrogen onto cold finger 50, then desorbing and vaporizing the condensed hydrogen with pulses from laser 52 results in a gaseous sample or pulse having molecules with substantially uniform kinetic energy. Since the various hydrogen isotope combinations have different masses, mass analysis is facilitated because the velocities of the various combinations differ and allow their separation on a time-of-flight basis. The packet or pulse contains some or all of the possible hydrogen isotope combinations in the form of subpulses distributed according to their mass. $H_2$, the lightest isotope of hydrogen, has the greatest velocity upon leaving cold finger 50 and therefore constitutes a subpulse at the leading edge of the sample pulse. $T_2$, the heaviest isotope, has the smallest velocity and forms a subpulse at the rear of the sample pulse.

The isotope mixture is ionized by resonance enhanced multiphoton ionization (REMPI) using a narrow-band, tunable laser (not shown). In photoionization processes, a photon interacts with a molecule to produce an ion. It is known that different isotopes of an element preferentially absorb light at different wavelengths. Thus, by tuning the laser to the appropriate wavelength, a particular isotope in a mixture can be ionized, while other isotopes remain substantially unionized. High selectivity can be achieved by programming the time delay between the two lasers (laser desorption light pulse and laser ionization pulse) and by tuning the wavelength to the isotope of interest in the gas pulse. For each desorbed hydrogen pulse containing all isotopic combinations (HH, DD, TT, HD, HT, DT), one isotope is preferentially ionized. Since the gas pulse consists of a series of subpulses corresponding to the different isotopic combinations, adjustments are made to compensate for the time delay for a particular isotope to reach the ionization region. The wavelength is also tuned to that particular isotope.

An advantage of REMPI is reduced fragmentation. It is known that some ionization sources induce fragmentation, that is, the breakdown of a molecular isotope to its constituent atoms or molecules. Thus, the isotope concentration of the ionized sample may not represent the isotope concentration of the original, un-ionized sample. Most preferably, ionization is carried out by REMPI due to the significantly lower fragmentation effects found with this technique as well as the preferential ionization capability discussed above. If convenient, ionization may be carried out by some other technique such as electron impact (EI) ionization. However, the particular advantages of REMPI or similar techniques—isotope separation and reduced fragmentation—are not found with other known techniques.

The ionized hydrogen packet enters QMS system 56, where the ionized molecules are analyzed by means well known in the art. The ions produce signal intensities and wavelengths which are indicative of the hydrogen isotope concentration of the sample.

The resolution of the measurement is improved over other methods since the hydrogen enters the ionization chamber of QMS system 56 as a discrete, high-concentration packet or pulse followed by only background or incidental hydrogen molecules. Measurements of background ionization between sample measurements also provide a method for overcoming the "memory" problem found in other systems. Since the sample is introduced as a pulse, the background reading can be readily distinguished from the signal of interest. The effects of background ionization can be eliminated from the sample signal mathematically.

Furthermore, the desorption and ionization steps described above give a pulse having a series of subpulses, each subpulse preferentially containing ions of a single isotope. This ion separation enhances the separation of different isotopes by the mass filter of the QMS. The three-step separation process—time-of-flight, ionization by REMPI, mass filter—results in significantly improved overall selectivity. A two-step separation process results if, as noted above, ionization is carried out by a technique which does not facilitate the separation of the different isotopes by their mass or by a nonselective ionization scheme.

The apparatus and method described herein can be used to analyze the hydrogen isotope concentration of gaseous mixtures, including air. Thus, apparatus 10 can be used for environmental testing and monitoring. Apparatus 10 can be used in hydrogen-isotope production facilities, where the isotopic content of both the product and the ambient air are of concern.

With suitable modifications, the apparatus can be used to measure the isotope concentration of other gases. For example, if oxygen or nitrogen is of interest, filter 22 is selectively permeable to oxygen or nitrogen, respectively. Also, if the filter allows other gases to pass along with the gas of interest, but blocks a gas that might be confused by the mass spectrometer with the gas of interest, such a filter may be use. Cold finger 50 is then maintained at an appropriate temperature so that the gas of interest will condense thereon.

It will be apparent to those skilled in the art that many changes and substitutions can be made to the preferred embodiment herein described without departing from the spirit and scope of the present invention as defined by the appended claims.

I claim:

1. An apparatus for preparing a sample for analysis by a mass spectrometer, said analysis being made of the concentrations of any isotopes of an element in said sample, apparatus comprising:

a first chamber having an interior;

a second chamber in fluid communication with an ionization chamber of said mass spectrometer, said second chamber having an interior;

a valve separating said first chamber from said second chamber, said valve having an open position and a closed position;

means for preferentially admitting said element into said first chamber;

means within said first chamber for collecting said element, said collecting means having a surface; and means proximate to said surface for vaporizing at least a portion of said element from said surface so that said portion can enter said second chamber, said vaporizing means producing a pulse of molecules having substantially uniform kinetic energies, said molecules of a lighter isotope of said element having a greater velocity than said molecules of a heavier isotope of said element so that, when said valve is in said open position, said molecules of said lighter isotope pass through said second chamber and reach said mass spectrometer before said molecules of said heavier isotope.

2. The apparatus as recited in claim 1, wherein said element is in the form of a gas and said collecting means further comprises means for condensing said gas onto said surface.

3. The apparatus as recited in claim 2, wherein said element is hydrogen and said admitting means further comprises a filter made of a material selected from the group consisting of palladium and a palladium alloy.

4. The apparatus as recited in claim 1, wherein said vaporizing means further comprises a laser.

5. The apparatus as recited in claim 1, wherein said vaporizing means is a pulsed laser.

6. The apparatus as recited in claim 1, further comprising a laser, said laser being tunable to selectively photoionize said molecules of a selected isotope of said element.

7. An apparatus for determining the concentrations of the isotopes of an element in a sample, said apparatus comprising:

a first chamber having an interior;

means for preferentially admitting said element into said first chamber;

a second chamber in fluid communication with an ionization chamber of said mass spectrometer, said second chamber having an interior;

a valve separating said first chamber from said second chamber, said valve having an open position and a closed position, said admitting means operable when said valve is in said closed position;

means within said first chamber for collecting said element, said collecting means having a surface;

means proximate to said surface for vaporizing at least a portion of said element from said surface, said vaporizing means operable when said valve is in said open position to produce a pulse of molecules having substantially uniform kinetic energies, said molecules of a lighter isotope of said element having a greater velocity than said molecules of a heavier isotope of said element so that said lighter molecules pass through said second chamber before said heavier molecules;

means for ionizing said at least a portion, said molecules of said lighter isotope being ionized before said molecules of said heavier isotope; and means for separating isotopes in said at least a portion by mass.

8. The apparatus as recited in claim 7, wherein said admitting means further comprises a permeable filter.

9. The apparatus as recited in claim 7, wherein said element is hydrogen and said admitting means further comprises a permeable filter made of a material selected from the group consisting of palladium and palladium alloy.

10. The apparatus as recited in claim 7, wherein said element is a gas and said collecting means further comprises means for condensing said gas on said surface.

11. The apparatus as recited in claim 7, wherein said element is hydrogen and said collecting means further comprises a cold finger held to a temperature not exceeding −252° C.

12. The apparatus as recited in claim 7, wherein said vaporizing means further comprises a laser.

13. The apparatus as recited in claim 7, wherein said vaporizing means is a pulsed laser.

14. The apparatus as recited in claim 7, wherein said ionizing means is resonance enhanced multiphoton ionization.

15. The apparatus as recited in claim 7, wherein said separating means further comprises a mass spectrometer system.

16. The method as recited in claim 15, wherein said vaporizing step is done by pulsing a laser onto at least a portion of said collected element.

17. The apparatus as recited in claim 7, wherein said ionizing means further comprises a laser, said laser being tunable to selectively photoionize said molecules of a selected isotope of said element.

18. A method for preparing a sample for analysis of the concentration of any isotopes of an element in said sample, said analysis being performed by a mass spectrometer, said method comprising the steps of:

separating said element from said sample;

collecting said element on a surface;

vaporizing at least a portion of said collected element proximate to an ionization chamber of said mass spectrometer to produce a pulse containing molecules with substantially uniform kinetic energies, said molecules of a lighter isotope of said element having a greater velocity than said molecules of a heavier isotope of said element so that said molecules of said lighter isotope reach said ionization chamber before said molecules of said heavier isotope;

when said molecules of an isotope of said element reach said ionization chamber, selectively ionizing said molecules of said isotope;

repeating said ionizing step for each of said isotopes of said element; and passing said ionized molecules through a mass filter of said mass spectrometer.

19. The method as recited in claim 18, wherein said element is a gas and said collecting step is done by condensing said element onto a cold surface.

20. The method as recited in claim 18, wherein said element is hydrogen and said separating step further comprises separating said hydrogen from said sample using a filter made of a material selected from the group consisting of palladium and palladium alloy, and said collecting of said hydrogen is done by condensing said hydrogen onto said surface.

* * * * *